US010786987B2

(12) United States Patent
Anderson et al.

(10) Patent No.: US 10,786,987 B2
(45) Date of Patent: Sep. 29, 2020

(54) ON-DIE TIME-SHIFTED ACTUATOR EVALUATION

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/483,811

(22) PCT Filed: Apr. 5, 2017

(86) PCT No.: PCT/US2017/026091
§ 371 (c)(1),
(2) Date: Aug. 6, 2019

(87) PCT Pub. No.: WO2018/186847
PCT Pub. Date: Oct. 11, 2018

(65) Prior Publication Data

US 2020/0023638 A1 Jan. 23, 2020

(51) Int. Cl.
*B41J 2/045* (2006.01)

(52) U.S. Cl.
CPC ..... *B41J 2/04573* (2013.01); *B41J 2/0458* (2013.01)

(58) Field of Classification Search
CPC ..... B41J 2/04573; B41J 2/0458
See application file for complete search history.

(56) References Cited

U.S. PATENT DOCUMENTS

| | | | | |
|---|---|---|---|---|
| 6,280,012 | B1 | 8/2001 | Schloeman | |
| 6,318,828 | B1 | 11/2001 | Barbour et al. | |
| 7,354,141 | B2 | 4/2008 | Ellson et al. | |
| 7,524,007 | B2 | 4/2009 | Pulver et al. | |
| 7,819,494 | B2 * | 10/2010 | Sheahan | B41J 2/0451 347/12 |
| 8,336,981 | B2 | 12/2012 | Chen | |

(Continued)

FOREIGN PATENT DOCUMENTS

| | | |
|---|---|---|
| CN | 102202897 | 9/2011 |
| CN | 103857530 | 6/2014 |

(Continued)

*Primary Examiner* — Thinh H Nguyen
(74) *Attorney, Agent, or Firm* — Fabian VanCott

(57) ABSTRACT

In one example in accordance with the present disclosure, a fluid ejection die is described. The die includes a number of actuator sensors disposed on the fluid ejection die to sense a characteristic of a corresponding actuator and to output a first voltage corresponding to the sensed characteristic c. Each actuator sensor is coupled to a respective actuator and multiple coupled actuator sensors and actuators are grouped as primitives on the fluid ejection die. The die also includes an actuator evaluation die per primitive to evaluate an actuator characteristic of any actuator within the primitive Based on the first voltage and a threshold voltage. The die also includes a time-shift chain component to communicate a delayed evaluation signal, which delayed evaluation signal delays an evaluation of the actuator characteristic a predetermined amount of time following an activation event.

15 Claims, 6 Drawing Sheets

(56) References Cited

U.S. PATENT DOCUMENTS

| | | | |
|---|---|---|---|
| 2005/0212869 | A1 | 9/2005 | Ellson et al. |
| 2012/0081471 | A1 | 4/2012 | Liao |
| 2013/0278656 | A1 | 10/2013 | Govyadinov et al. |

FOREIGN PATENT DOCUMENTS

| | | |
|---|---|---|
| CN | 104998702 | 10/2015 |
| CN | 105939858 | 9/2016 |
| JP | H02255351 | 10/1990 |
| WO | WO-9632263 | 10/1996 |
| WO | WO-2016003403 | 1/2016 |
| WO | WO-2016163105 | 10/2016 |
| WO | WO-2017023291 | 2/2017 |

* cited by examiner

ON-DIE TIME-SHIFTED ACTUATOR EVALUATION

BACKGROUND

A fluid ejection die is a component of a fluid ejection system that includes a number of nozzles. The dies can also include other actuators such as micro-recirculation pumps. Through these nozzles and pumps, fluid, such as ink and fusing agent among others, is ejected or moved. Over time, these nozzles and actuators can become dogged or otherwise inoperable. As a specific example, over time, ink in a printing device can harden and crust, thereby blocking the nozzle and interrupting the operation of subsequent ejection events. Other examples of Issues affecting these actuators include fluid fusing on an ejecting element, particle contamination, surface puddling and surface damage to die structures. These and other scenarios may adversely affect operations of the device in which the die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
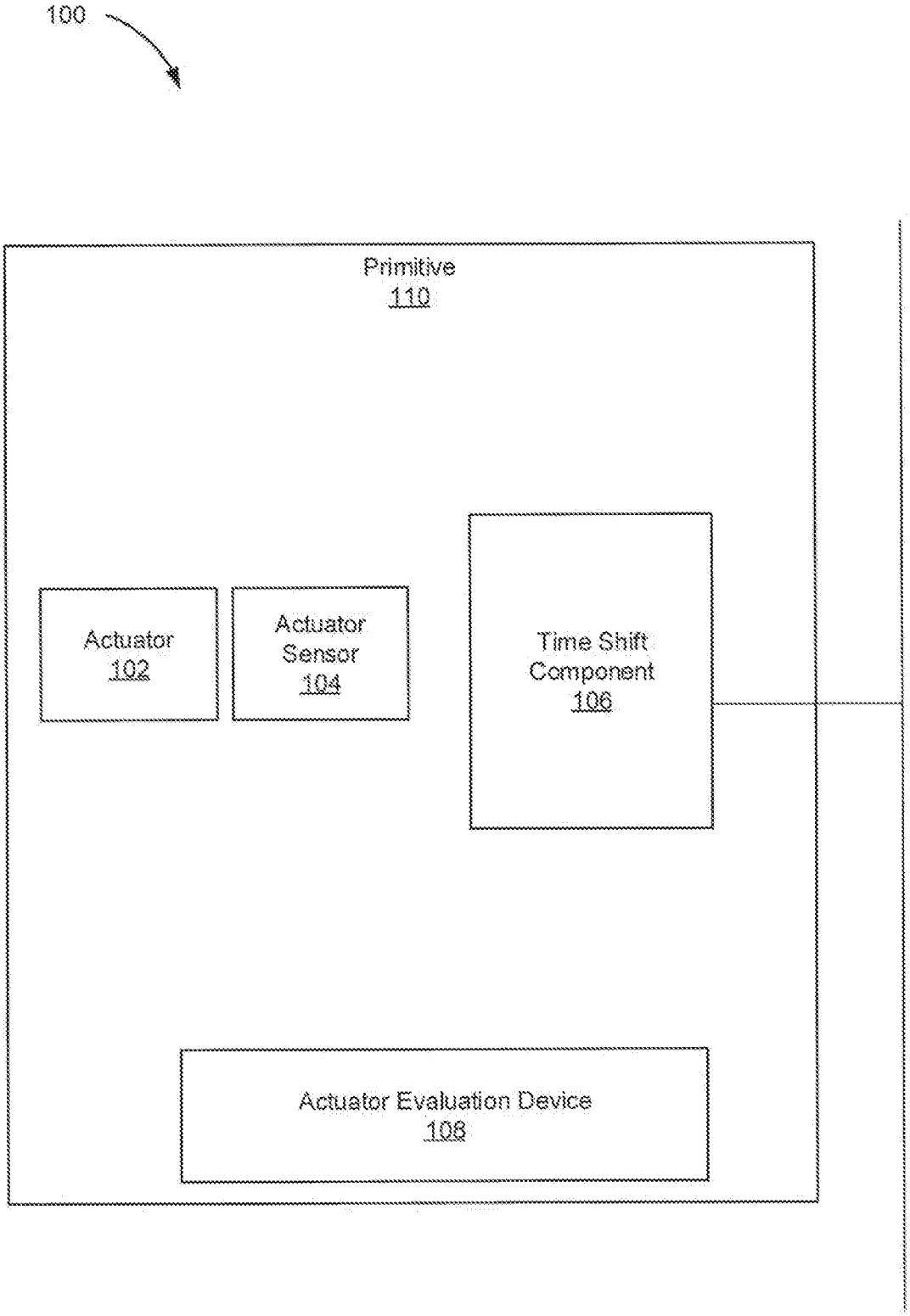
FIGS. 1A and 1B are block diagrams of a fluid ejection die including on-die time-shifted actuator evaluation components, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

A fluid ejection die is a component of a fluid ejection system that includes a number of actuators. These actuators may come in the form of nozzles that eject fluid from a die, or non-ejecting actuators, such as recirculation pumps that circulate fluid throughout the fluid channels on the die. Through these nozzles and pumps, fluid, such as ink and fusing agent among others, is ejected or moved.

Specific examples of devices that rely on fluid ejection systems include, but are not limited to, inkjet printers, multi-function printers (MFPs), and additive manufacturing apparatuses. The fluid ejection systems in these systems are widely used for precisely, and rapidly, dispensing small quantities of fluid. For example, in an additive manufacturing apparatus, the fluid ejection system dispenses fusing agents. The fusing agent is deposited on a build material, which fusing agent facilitates the hardening of build material to form a three-dimensional product.

Other fluid ejection systems dispense ink on a two-dimensional print medium such as paper. For example, during inkjet printing, ink is directed to a fluid ejection die. Depending on the content to be printed, the device in which the fluid ejection system is disposed, determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing operation, i.e., depositing fluid on a substrate, and in a three-dimensional printing, i.e., depositing a fusing agent on a material base to form a three-dimensional printed product.

To eject the fluid, these fluid ejection dies include nozzles and other actuators. Fluid is ejected from the die via nozzles and is moved throughout the die via other actuators, such as pumps. The fluid ejected through each nozzle comes from a corresponding fluid reservoir in fluid communication with the nozzle.

To eject the fluid, each nozzle includes various components. For example, a nozzle includes an ejector an ejection chamber, and a nozzle orifice. An ejection chamber of the nozzle holds an amount of fluid. An ejector in the ejection chamber operates to eject fluid out of the ejection chamber, through the nozzle orifice. The ejector may include a thermal resistor or other thermal device, a piezoelectric element, or other mechanism for ejecting fluid from the firing chamber.

While such fluid ejection systems and dies undoubtedly have advanced the field of precise fluid delivery, some conditions impact their effectiveness. For example, the nozzles on a die are subject to many cycles of heating drive bubble formation, drive bubble collapse, and fluid replenishment from a fluid reservoir. Overtime, and depending on other operating conditions, the nozzles may become blocked or otherwise defective. For example, particulate matter, such as dried ink or powder build material, can block the nozzle. This particulate matter can adversely affect the formation and release of subsequent printing fluid. Other examples of scenarios that may impact the operation of a printing device include a fusing of the printing fluid on the ejector element, surface puddling, and general damage to components within the nozzle. As the process of depositing fluid on a surface is a precise operation, these blockages can have a deleterious effect on print quality. If one of these actuators fails, and is continually operated following failure, then it may cause neighboring actuators to fail.

Accordingly, the present specification describes a method to determine whether a particular actuator has failed. Specifically, the present specification describes a die that includes on-die components that evaluate whether an actuator is operating as expected. In doing so, the on-die components compare an output voltage that is indicative of a condition of the actuator against a threshold voltage.

However, as there are hundreds or even thousands of actuators on a fluid ejection die, it is undesirable to activate all actuators at the same time, which would generate a significant current ramp on the fluid ejection die introducing noise into adjacent transmission lines, which transmission lines are used for passing activation signals to the different actuators. The noise adversely affects many operations of a fluid die including at least actuator activation and actuator evaluation.

Accordingly, the activation signals passed to the different primitives may be delayed. That is the signals that are actually received at an actuator are delayed with respect to an initial activation signal issued from a controller. This is an intentional delay that facilitates power management on the fluid ejection die by spreading out the time of turning actuators on and off to reduce the magnitude of a current charge on the fluid ejection die. This delayed activation signal is then delayed again for each subsequent primitive as it propagates up or down a column from one primitive to the next. This results in a delay at each primitive being different from other primitives.

This delay, while improving die performance, increases the complexity of actuator evaluation. That is, actuator evaluation may occur a predetermined period of time after an activation signal is received at the actuator for example, 3 microseconds. As the timing of arrival of the activation signal changes with respect to different primitives, a simple global evaluation signal will not ensure that the evaluation occurs a predetermined period of time following activation. That is, if the actual time an activation signal is received by an actuator is uncertain, it is not possible to send a global signal to initialize an evaluation of the actuator a predetermined period of the following the delayed activation.

Accordingly, the present method and systems describe providing a delayed evaluation signal to the actuator evaluation device, which initializes an evaluation of a particular actuator. This delay in the evaluation signal corresponds to the delay in the activation signal previously described. That is, both the activation signal and evaluation signal are delayed by the same clock line. In so doing, the same delay that is generated in the transmission of an activation signal is also generated in the transmission of an evaluation signal. Accordingly, returning to the specific numeric example above, the evaluation signal wilt always activate 3 microseconds after the activation signal, regardless of any delay to the activation signal.

Specifically, the present specification describes a fluid ejection die. The fluid ejection die includes a number of actuator sensors disposed on the fluid ejection die to sense a characteristic of a corresponding actuator and to output a first voltage corresponding to the sensed characteristic. Each actuator sensor is coupled to a respective actuator and multiple coupled actuator sensors and actuators are grouped as primitives on the fluid ejection die. The fluid ejection die also includes an actuator evaluation device per primitive to evaluate an actuator characteristic of any actuator within the primitive based on the first voltage and a threshold voltage. The fluid ejection die also includes a time-shift chain to communicate a delayed evaluation signal to the actuator evaluation device. The delayed evaluation signal delays an evaluation of the actuator characteristic a predetermined amount of time following an activation event.

The present specification also describes a fluid ejection system that includes multiple fluid ejection dies. A fluid ejection die includes a number of drive bubble detection devices to output a first voltage indicative of a state of a corresponding actuator. Each drive bubble detection device is coupled to a respective actuator of the number of the actuators and multiple coupled drive bubble detection devices and actuators are grouped as primitives on the fluid ejection die. Each die also includes an actuator evaluation device per primitive to evaluate an actuator characteristic of the actuator based at least in part on a comparison of the first voltage and a threshold voltage. Each fluid ejection die also includes a time-shift chain to communicate a delayed evaluation signal to the actuator evaluation device. The delayed evaluation signal delays an evaluation of the actuator characteristic a predetermined amount of time following an activation event.

The present specification also describes a method for evaluating actuator characteristics on a fluid ejection die. According to the method, an activation signal for an actuator of a primitive is received and the actuator is activated based on the activation signal. An evaluation signal for evaluating a characteristic of the actuator is received and delayed at the primitive a predetermined amount of time following the activation signal. An actuator characteristic is then evaluated, responsive to a receipt of the delayed evaluation signal, based at least in part on a comparison of the first voltage and a threshold voltage.

In this example, the actuator sensor actuator, time-shift chain, and evaluation components are disposed on the fluid ejection die itself as opposed to being off die, for example as a part of printer circuitry or other fluid ejection system circuitry. When such actuator evaluation circuitry is not on the fluid ejection die, gathered information from an actuator sensor is passed off die where it is used to determine a state of the corresponding actuator. Accordingly, by incorporating these elements directly on the fluid ejection die, increased technical functionality of a fluid ejection die is enabled. For example printer-die communication bandwidth are reduced when sensor information is not passed off-die, but is rather maintained on the fluid ejection die when evaluating an actuator. On-die circuitry also reduces the computational overhead of the printer in which the fluid ejection die is disposed. Still further, having such actuator evaluation circuitry on the fluid ejection die itself removes the printer from managing actuator service and/or repair and localizes it to the die itself. Additionally, by not locating such sensing and evaluation circuitry off-die, but maintaining it on the fluid ejection die, there can be faster responses to malfunctioning actuators. Still further, positioning this circuitry on the fluid ejection die reduces the sensitivity of these components to electrical noise that could corrupt the signals if they were driven off the fluid ejection die.

In summary, using such a fluid ejection die 1) allows for nozzle evaluation circuitry to be disposed on the die itself, as opposed to sending sensed signals to nozzle evaluation circuitry off die; 2) increases the efficiency of bandwidth usage between the device and die; 3) reduces computation overhead for the device in which the fluid ejection die is disposed; 4) provides improved resolution times for malfunctioning nozzles; 5) allows for actuator evaluation in one primitive while allowing continued operation of actuators in another primitive; 6) places management of nozzles on the fluid ejection die as opposed to on the printer in which the fluid ejection die is installed; and 7) improves the accuracy of actuator evaluation by allowing for delayed activation signals to be used, which reduce the effects of noise on any activation of an actuator. However, it is contemplated that the devices disclosed herein may address other matters and deficiencies in a number of technical areas.

As used in the present specification and in the appended claims, the term "actuator" refers to a nozzle or another non-ejecting actuator. For example, a nozzle, which is an actuator, operates to eject fluid from the fluid ejection die. A recirculation pump, which is an example of a non-ejecting actuator, moves fluid throughout the fluid slots, channels and pathways within the fluid ejection die.

Accordingly, as used in the present specification and in the appended claims, the term "nozzle" refers to an individual component of a fluid ejection die that dispenses fluid onto a surface. The nozzle includes at least an ejection chamber, an ejector, and a shared nozzle orifice.

Further, as used in the present specification and in the appended claims, the term "fluid ejection die" refers to a component of a fluid ejection device that includes a number of nozzles through which a printing fluid is ejected. Groups of actuators are categorized as "primitives" of the fluid ejection die. In one example, a primitive may include between 8-16 actuators. However, a primitive can include any integer number of actuators. The fluid ejection die may be organized first into two columns with 30-150 primitives per column. The primitives of a fluid ejection die can be grouped into any number of columns.

Still further, as used in the present specification and in the appended claims, the term "time-shift chain component" refers to any component that delays an incoming signal. In some examples, the component may impart a digital delay. An example of such a component would be a flip-flop. In other examples, the component may impart an analog delay. In this example, the component may be a buffer that is designed to have some particular input to output time characteristic.

Even further, as used in the present specification and in the appended claims, the term "a number of" or similar language is meant to be understood broadly as any positive number including 1 to infinity.

Figure 1B:
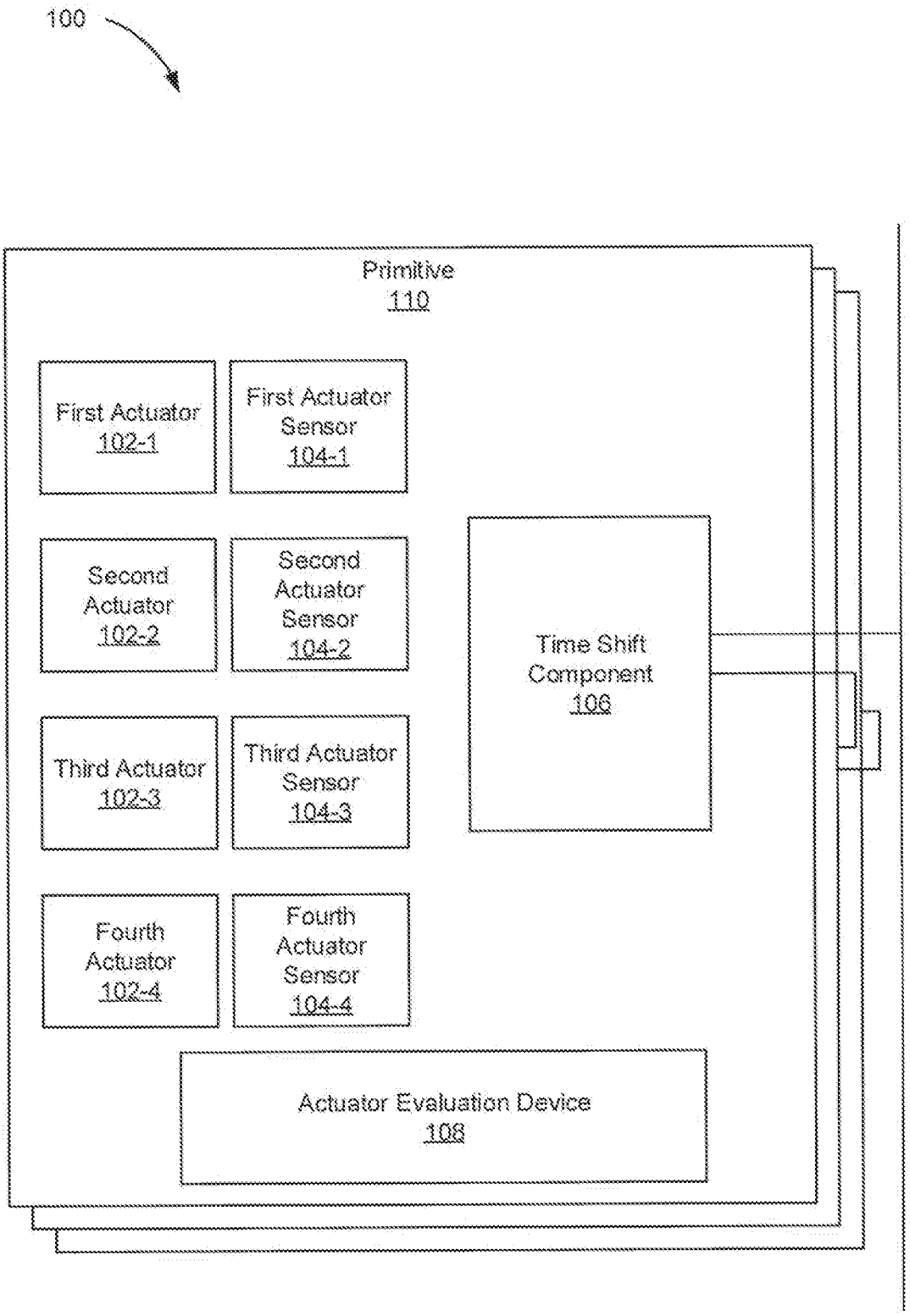

FIGS. 1A and 1B are block diagrams of a fluid ejection die (100) including on-die time-shifted actuator evaluation components, according to an example of the principles described herein. As described above, the fluid ejection die (100) is a component of a fluid ejection system that houses components for ejecting fluid and/or transporting fluid along various pathways. The fluid that is ejected and moved throughout the fluid ejection die (100) can be of various types including ink, biochemical agents, and/or fusing agents FIG. 1A depicts a fluid ejection die (100) with an actuator (102), an actuator sensor (104), a time-shift chain component (106), and an actuator evaluation device (108) disposed on a primitive (110). FIG. 1B depicts a fluid ejection die (100) with multiple actuators (102), multiple actuator sensors (104), multiple time-shift chain components (106), and an actuator evaluation device (108) disponed on each primitive (110).

The fluid ejection die (100) includes various actuators (102) to eject fluid from the fluid ejection die (100) or to otherwise move fluid throughout the fluid ejection die (100). In some cases there may be one actuator (102) per primitive (110) as depicted in FIG. 1A, in other examples there may be multiple actuators (102-1, 102-2, 102-3, 102-4) per primitive (110) as depicted in FIG. 1B. The actuators (102) may be of varying types. For example, nozzles are one type of actuator (102) that operates to eject fluid from the fluid ejection die (100). Another type of actuator (102) is a recirculation pump that moves fluid between a nozzle channel and a fluid slot that feeds the nozzle channel. While the present specification may make reference to a particular type of actuator (102), the fluid ejection die (100) may include any number and type of actuators (102). Also, within the figures the indication "-" refers to a specific instance of a component. For example, a first actuator is identified as (102-1). By comparison, the absence of an indication "-*" refers to the component in general. For example, an actuator in general is referred to as an actuator (102).

Returning to the actuators (102). A nozzle is a type of actuator that ejects fluid originating in a fluid reservoir onto a surface such as paper or a build material volume. Specifically, the fluid ejected by the nozzles may be provided to the nozzle via a fluid feed slot, or an ink feed hole array, in the fluid ejection die (100) that fluidically couples the nozzles to a fluid reservoir. In order to eject the fluid, each nozzle includes a number of components, including an ejector, an ejection chamber, and a nozzle orifice. An example of an ejector ejection chamber, and a nozzle orifice are provided below in connection with FIG. 2B.

The fluid ejection die (100) also includes actuator sensors (104) disposed on the fluid ejection die (100). In some cases there may be one actuator sensor (104) per primitive (110) as depicted in FIG. 1A, in other examples there may be multiple actuator sensors (104-1, 104-2, 104-3, 104-4) per primitive (110) as depicted in FIG. 1B. The actuator sensors (104) sense a characteristic of a corresponding actuator (102). For example, the actuator sensors (104) may be used to measure an impedance near an actuator (102). As a specific example, the actuator sensors (104) may be drive bubble detectors that enable the detection of the presence of a drive bubble within an ejection chamber of a nozzle. In some examples, the actuator sensors (104) may be uniquely paired with actuators (102) as depicted in FIG. 1B. That is each ejector of an actuator (102) may have a unique plate disposed over it. In other examples, a single actuator sensor (104) may be shared by multiple actuators (102). For example, the actuator sensor (104) may be a single plate that covers multiple ejectors of multiple actuators (102).

A drive bubble is generated by an ejector element to move fluid in the ejection chamber. Specifically, in thermal inkjet printing, a thermal ejector heats up to vaporize a portion of fluid in an ejection chamber. As the bubble expands, it forces fluid out of the nozzle orifice and also towards the ink feed slot. As the bubble collapses, a negative pressure within the ejection chamber draws fluid from the fluid feed slot of the fluid ejection die (100). Sensing the proper formation and collapse of such a drive bubble can be used to evaluate whether a particular nozzle is operating as expected. That is, a blockage in the nozzle will affect the formation of the drive bubble. If a drive bubble has not formed as expected, it can be determined that the nozzle is blocked and/or not working in the intended manner.

The presence of a drive bubble can be detected by measuring impedance values within the ejection chamber at different points in time. That is, as the vapor that makes up the drive bubble has a different conductivity than the fluid that otherwise is disposed within the chamber when a drive bubble exists in the ejection chamber, a different impedance value will be measured. Accordingly, a drive bubble detection sensor is used to measure this impedance and outputs a corresponding voltage. As will be described below, this output can be used to determine whether a drive bubble is properly forming and therefore determining whether the corresponding nozzle or pump is in a functioning or malfunctioning state. This output can be used to trigger subsequent actuator (102) management operations. While description has been provided of an impedance measurement, other characteristics may be measured to determine the characteristic of the corresponding actuator (102).

As described above, in some examples such as that depicted in FIG. 1B, each actuator sensor (104) of the number of actuator sensors (104) may be coupled to a respective actuator (102) of the number of actuators (102). In one example, each actuator sensor (104) is uniquely paired with the respective actuator (102). For example, a first actuator (102-1) may be uniquely paired with a first actuator sensor (104-1). Similarly, the second actuator (102-2), third actuator (102-3), and fourth actuator (102-4) may be uniquely paired with the second actuator sensor (104-2), third actuator sensor (104-3), and fourth actuator sensor (104-4). Multiple pairings of actuators (102) and actuator sensors (104) may be grouped together in a primitive (110) of the fluid ejection die (100). That is the fluid ejection die (100) may include any number of actuator (102)/actuator sensor (104) pairs grouped as primitives (110). Pairing the actuators (102) and actuator sensors (104) in this fashion increases the efficiency of actuator (102) management. While FIG. 1B depicts multiple actuators (102) and actuator sensors (104), a primitive (110) may have any number of actuator (102)/actuator sensor (104) pairs, including one, as depicted in FIG. 1A.

Including the actuator sensors (104) on the fluid ejection die (100), as opposed to some off die location such as on the printer, also increases efficiency. Specifically, it allows for sensing to occur locally, rather than off-die, which increases the speed with which sensing can occur.

The fluid ejection die (100) also includes an actuator evaluation device (108) per primitive (110). The actuator evaluation device (108) evaluates an actuator (102) based at least on an output of the actuator sensor (104). For example, a first actuator sensor (104-1) may output a voltage that corresponds to an impedance measurement within an ejection chamber of a first nozzle. This voltage may be compared against a threshold voltage, which threshold voltage delineates between an expected voltage with fluid present and an expected voltage with air present in the ejection chamber.

As a specific example, a voltage lower than the threshold voltage may indicate that fluid is present, which fluid has a lower impedance than fluid vapor. Accordingly, a voltage higher than the threshold voltage may indicate that vapor is present, which vapor has a higher impedance than fluid. Accordingly, at a time when a drive bubble is expected, a voltage output from an actuator sensor (104) that is higher than, or equal to, the threshold voltage would suggest the presence of a drive bubble while a voltage output from an actuator sensor (104) that is lower than the threshold voltage would suggest the lack of a drive bubble. In this case, as a drive bubble is expected, but the first voltage does not suggest such a drive bubble current is forming, it can be determined that the nozzle under test has a malfunctioning characteristic. While a specific relationship, i.e., low voltage indicates fluid, high voltage indicates air, has been described, any desired relationship can be implemented in accordance with the principles described herein.

In some examples, to property determine whether an actuator (102) is functioning as expected, the corresponding actuator sensor (104) may take multiple measurements relating to the corresponding actuator (102), and the actuator evaluation device (108) may evaluate multiple measurement values before outputting an indication of the state of the actuator (102). The different measured values may be taken at different time intervals following a firing event. Accordingly, the different measured values are compared against different threshold voltages. Specifically, the impedance measurements that indicate a properly forming drive bubble are a function of time. For example, a drive bubble at its largest yields a highest impedance, then as the bubble collapses over time, the impedance measure drops due to the reduced amount of air in the ejection chamber while it refills with fluid. Accordingly, the threshold voltage that indicates a properly forming drive bubble also changes over time. Comparing multiple voltage values against multiple threshold voltages following a firing event provides greater confidence in a determined state of a particular actuator (102).

The fluid ejection die (100) also includes a time-shift chain, with a time-shift chain component (106) per primitive. The time-shift component (106) may be a component of a larger global time-shift chain that passes by each primitive (110) on the fluid ejection die (100). The time-shift chain and corresponding time-shift components (106) may be analog, i.e., a buffer, or digital, i.e., a flip-flop. The time-shift chain delays an evaluation signal to the respective primitive (110). Specifically, a first time-shift chain may work to delay the activation signals passed to each primitive (110).

For example, a series of flip-flaps may be present along an activation time-shift chain that allows the different primitives (110) to be activated sequentially given a single global activation signal. As a specific example, at a time t0 an activation signal is passed along a global line, at a time t1, an actuator (102) on a first primitive (110) is activated, at a time t2, an actuator (102) on a second primitive (110) is activated, and at a time t3, an actuator (102) on a third primitive (110) is activated. Accordingly, the activation signals that activate the actuators on a primitive (110) may be delayed. The time-shift chain component (106) described herein delays an evaluation of the actuator characteristic, by the actuator evaluation device (108), a predetermined amount of time following an activation signal. Doing so ensures that the evaluation signal received by each actuator evaluation device (108) of the different primitives has a uniform time gap relative to the respective activation signals. For example, at a time t3, an evaluation signal is passed along a global line, at a time t4, an actuator evaluation device (108) on a first primitive (110) is activated, at a time t5, an actuator evaluation device (108) on a second primitive (110) is activated, and at a time t6, an actuator evaluation device (108) on a third primitive (110) is activated. In other words, the time-shift chain components (106) ensure that a predetermined delay is maintained between each activation of an actuator (102) on a primitive (110) and an evaluation of that actuator (102) on that primitive (110), regardless of a delay on the activation signal. In some examples, the time-shift chain for the evaluation signal may mirror a time-shift chain for the activation signal.

As can be seen in FIGS. 1A and 1B, the actuator evaluation device (108) and the time-shift chain component (106) are per primitive (110). That is a single actuator evaluation device (108) and a local component (106) of the time-shift chain interface with, and are uniquely paired with, just those actuators (102) and just those actuator sensors (104) of that particular primitive (110).

Figure 2A:
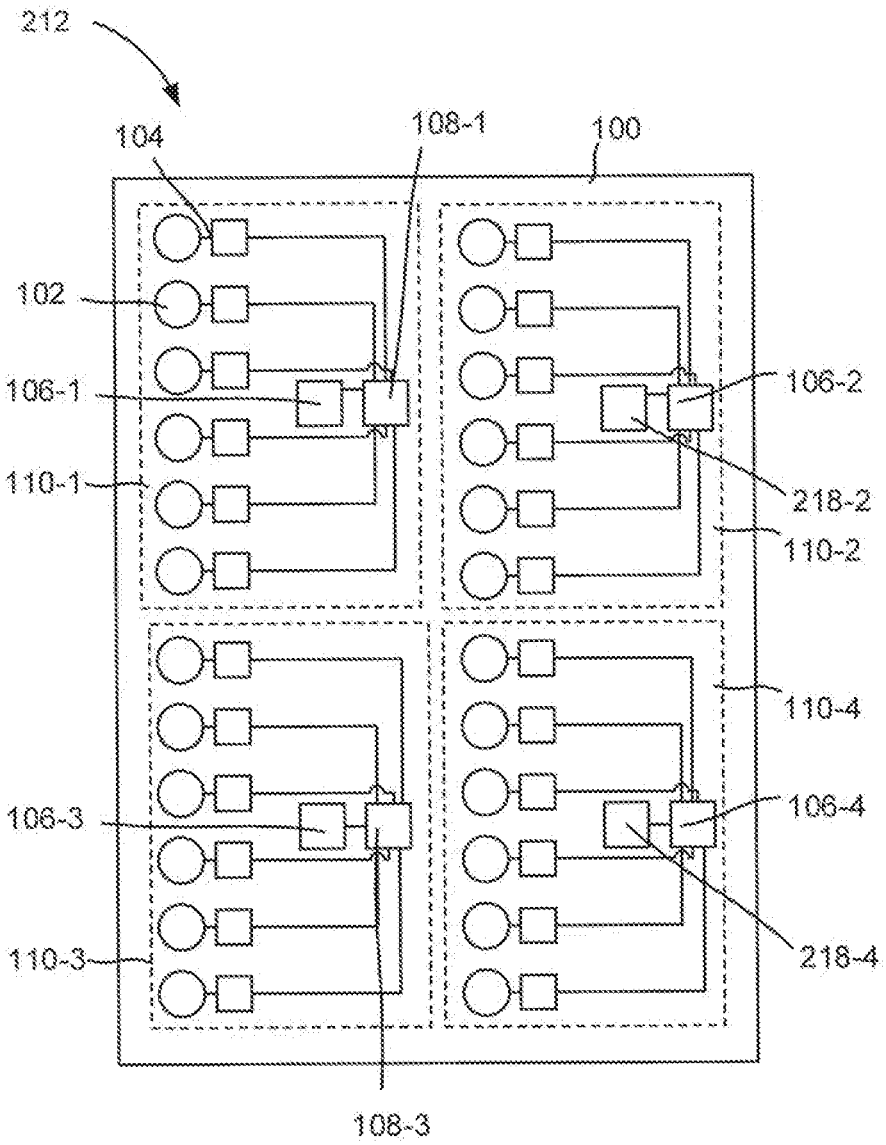
FIG. 2A is a block diagram of a fluid ejection system including on-die time-shifted actuator evaluation components, according to an example of the principles described herein.

FIG. 2A is a block diagram of a fluid ejection system (212) inducing on-die time-shifted actuator evaluation components, according to an example of the principles described herein. The system (212) includes a fluid ejection die (100) on which multiple actuators (102) and corresponding actuator sensors (104) are disposed. For simplicity, a single instance of an actuator (102), an actuator sensor (104) are indicated with reference numbers. However, a fluid ejection die (100) may include any number of actuators (102) and actuator sensors (104). In the example depicted in FIG. 2A the actuators (102) and actuator sensors (104) are arranged into columns. However, the actuators (102) and actuator sensors (104) can be grouped into any other physical arrangement or array. The actuators 1102) and actuator sensors (104), along with their corresponding pre-charge devices (218) and actuator evaluation devices (108) may be grouped into primitives (110-1, 110-2, 110-3, 110-4). In the case of actuators (102) that are fluid ejection nozzles, one nozzle per primitive (110) is activated at a time. While FIG. 2A depicts six components per primitive (110), primitives (110) may have any number of these components.

Figure 2B:
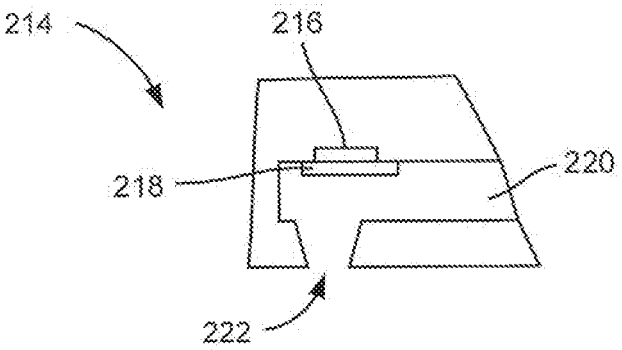
FIG. 2B is a cross-sectional diagram of a nozzle of the fluid ejection system depicted in FIG. 2A, according to an example of the principles described herein.

FIG. 2B is a cross-sectional diagram of a nozzle (214) of the fluid ejection system (212) depicted in FIG. 2A, according to an example of the principles described herein. As described above, a nozzle (214) is an actuator (102) that operates to eject fluid from the fluid ejection die (100) which fluid is initially disposed in a fluid reservoir that is fluidically coupled to the fluid ejection die (100). To eject the fluid, the nozzle (214) includes various components. Specifically, a nozzle (214) includes an ejector (108), an ejection chamber (220), and a nozzle orifice (222). The nozzle orifice (222) may allow fluid, such as ink, to be deposited onto a surface, such as a print medium. The ejection chamber (220) may hold an amount of fluid. The ejector (108) may be a mechanism for ejecting fluid from the ejection chamber (220) through the nozzle orifice (222), where the ejector (108) may include a firing resistor or other thermal device, a piezoelectric element, or other mechanism for ejecting fluid from the ejection chamber (220).

In the case of a thermal inkjet operation, the ejector (108) is a heating element. Upon receiving the firing signal, the heating element initiates heating of the ink within the ejection chamber (220). As the temperature of the fluid in proximity to the heating element increases, the fluid may vaporize and form a drive bubble. As the heating continues, the drive bubble expands and forces the fluid out of the nozzle orifice (222). As the vaporized fluid bubble collapses, a negative pressure within the ejection chamber (220) draws fluid into the ejection chamber (220) from the fluid supply, and the process repeats. This system is referred to as a thermal inkjet system.

FIG. 2B also depicts a drive bubble detection device (218). The drive bubble detection device (218) depicted in FIG. 2B is an example of an actuator sensor (104) depicted in FIG. 2A. Accordingly, as with the actuator sensors, each drive bubble detection device (218) is coupled to a respective actuator (102) of the number of actuators (102) and the drive bubble detection devices (224) are part of a primitive (110) to which the corresponding actuator (102) is a component.

The drive bubble detection device (218) may include an electrically conductive plate, such as a tantalum plate, which can detect impedance of whatever medium is within the ejection chamber (220). Specifically, each drive bubble detection device (218) measures an impedance of the medium within the ejection chamber (220), which impedance measure can indicate whether a drive bubble is present in the ejection chamber (220). The drive bubble detection device (218) then outputs a first voltage value indicative of a state, i.e., drive bubble formed or not, of the corresponding nozzle (214). This output can be compared against a threshold voltage to determine whether the nozzle (214) is malfunctioning or otherwise inoperable.

Returning to FIG. 2A, the system (212) also includes a number of time-shift chain components (106-1, 106-2, 106-3, 106-4). Specifically, the system (212) includes a time-shift chain component (106) per primitive (110). That is, each of the time-shift chain components (106-1, 106-2, 106-3, 106-4) may be uniquely paired with a corresponding primitive (110-1, 110-2, 110-3, 110-4). That is, a first primitive (110-1) may be uniquely paired with a first time-shift chain component (106-1). Similarly, a second primitive (110-2), third primitive (110-3), and a fourth primitive (110-4) may be uniquely paired with a second time-shift chain component (106-2), third time-shift chain component (106-3), and fourth time-shift chain component (106-4), respectively. The time-shift chain components (106) delay a global evaluation signal a predetermined amount of time following an activation signal, regardless of any delay imposed on the activation signal. That is, each primitive (110) may have a component that delays a global evaluation signal as it is received locally at that primitive (110). The time-shift chain component (106) for that primitive (110) ensures that a global evaluation signal received locally at that primitive (110) is delayed by the same amount, thus ensuring that for the primitives (110) on a fluid ejection die (FIG. 1A. 100): there is a uniform gap between the local activation signals and the local evaluation signals for all primitives (110).

Returning to FIG. 2A, the system (212) also includes a number of actuator evaluation devices (108-1, 108-2, 108-3, 108-4). Specifically, the system (212) includes an actuator evaluation device (108) per primitive. That is, each of the actuator evaluation devices (108-1, 108-2, 108-3, 108-4) may be uniquely paired with a corresponding primitive (110-1, 110-2, 110-3, 110-4). That is, a first primitive (110-1) may be uniquely paired with a first actuator evaluation device (108-1). Similarly, a second primitive (110-2), third primitive (110-3), and a fourth primitive (110-4) may be uniquely paired with a second actuator evaluation device (108-2), third actuator evaluation device (108-3), and fourth actuator evaluation device (108-4), respectively. In one example, each actuator evaluation device (108) corresponds to just the number of actuators (102) and just the number of actuator sensors (104) within that particular primitive (110).

The actuator evaluation devices (108) evaluate a characteristic of the actuators (102) within their corresponding primitive (110) based at least in part on an output of an actuator sensor (104) corresponding to the actuator (102), and a threshold voltage. That is an actuator evaluation device (108) identifies a malfunctioning actuator (102) within its primitive (110). For example, a threshold voltage may be such that a voltage lower than the threshold would indicate an actuator sensor (104) in contact with fluid and a voltage higher than the threshold voltage would indicate an actuator sensor (104) that is in contact with vapor, i.e., a drive bubble. Accordingly, per this comparison of the precharged threshold voltage and the first voltage, it can be determined whether vapor or fluid is in contact with the actuator sensor (104) and accordingly, whether an expected drive bubble has been formed. While one particular relationship, i.e., low voltage indicating fluid and high voltage indicating vapor, has been presented, other relationships could exist, i.e., high voltage indicating fluid and low voltage indicating vapor.

As described above, the actuator evaluation device (108) may be activated based on the evaluation signal, which is delayed by the time-shift chain component (106) for that primitive (110). That is, the actuator sensor (104) and actuator evaluation devices (108) may be continuously operating to evaluate an actuator (102), however, it is not until an evaluation signal is received via the time-shift chain component (106) that any result of evaluation is stored and passed on to a controller for subsequent operation.

Including the actuator evaluation device (108) on the fluid ejection die (100) improves the efficiency of actuator evaluation. For example, in other systems, any sensing information collected by an actuator sensor (104) is not per actuator (102), nor is it assessed on the fluid ejection die (100), but is rather routed off the fluid ejection die (100) to a printer, which increases communication bandwidth usage between the fluid ejection die (100) and the printer in which it is installed. Moreover such primitive/actuator evaluation device pairing allows for the localized "in primitive" assessment which can be used locally to disable a particular actuator (102), without involving the printer or the rest of the fluid ejection die (100).

Including an actuator evaluation device (108) per primitive (110) increases the efficiency of actuator evaluation. For example, were the actuator evaluation device (108) to be located off die, while one actuator (102) is being tested all the actuators (102) on the die (100), not just those in the same primitive (110), would be deactivated so as to not interfere with the testing procedure. However, where testing is done at a primitive (110) level other primitives (110) of actuators (102) can continue to function to eject or move fluid. That is, an actuator (102) corresponding to the first primitive (110-1) may be evaluated while actuators (102) corresponding to the second primitive, (110-2), the third primitive (110-3), and the fourth primitive (110-4) may continue to operate to deposit fluid to form printed marks.

Following this companion, the actuator evaluation devices (108) may generate an output indicative of a failing actuator of the fluid ejection die (100). This output may be a binary output, which could be used by downstream systems to carry out any number of operations.

Figure 3:
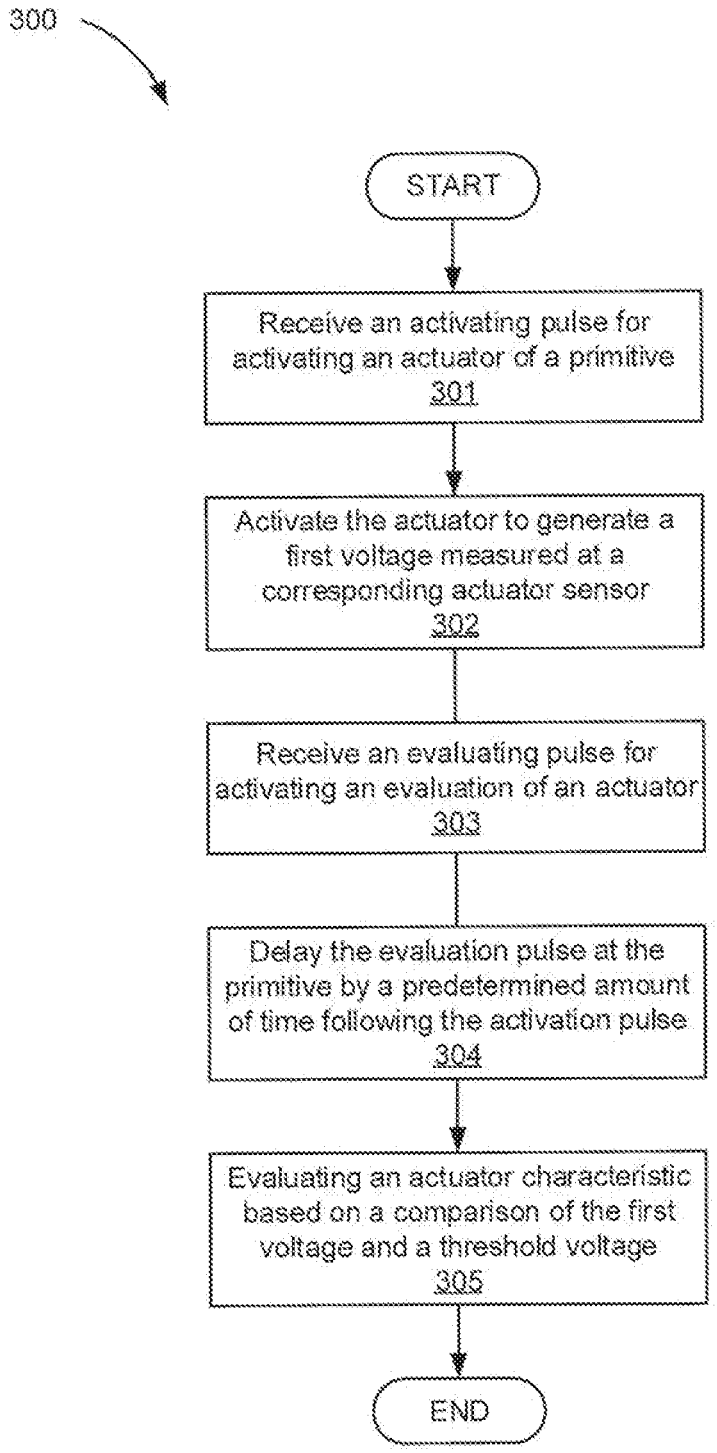
FIG. 3 is a flowchart of a method for performing on-die time-shifted actuator evaluation, according to an example of the principles described herein.

FIG. 3 is a flowchart of a method (300) for performing on-die time-shifted actuator (FIG. 1A, 102) evaluation, according to an example of the principles described herein. According to the method (300), an activation signal is received (block 301) at an actuator (FIG. 1A, 102). That is, a controller, or other off-die or on-die device, sends an electrical impulse that initiates an activation event. For a non-ejecting actuator, such as a recirculation pump, the activation signal may activate a component to move fluid throughout the fluid channels and fluid slots within the fluid ejection die (FIG. 1A, 100). In a nozzle, (FIG. 2B, 214), the activation signal may be a firing signal that causes the ejector (FIG. 2B, 216) to eject fluid from the ejection chamber (FIG. 2B, 220).

In the specific example of a nozzle, the activation signal may include a pre-charge pulse that primes the ejector (FIG. 2B, 216). For example, in the case of a thermal ejector, the pre-change may warm up the heating element such that the fluid inside the ejection chamber (FIG. 2B, 220) is heated to a near-vaporization temperature. After a slight delay, a firing pulse is passed, which heats the heating element further so as to vaporize a portion of the fluid inside the ejection chamber (FIG. 2B, 220).

Receiving (block 301) the activation signal at an actuator (FIG. 1A, 102) to be actuated may include directing a global activation signal to a particular actuator (FIG. 1A, 102). That is, the fluid ejection die (FIG. 1A, 100) may include an actuator select component that allows the global activation signal to be passed to a particular actuator for activation. The actuator (FIG. 1A, 102) that is selected is part of a primitive (FIG. 1A. 110). It may be the case that one actuator (FIG. 1A, 102) per primitive (FIG. 1A, 110) may be activated at any given time.

In some examples, the activation signal may be a delayed activation signal. That is the global signal may be delayed, at the primitive (FIG. 1A, 100) which delay may result in a unique firing of that actuator (FIG. 1A, 102). For example, at a first primitive (FIG. 1A, 100), the activation signal may be delayed one clock cycle, and at a second primitive (FIG. 1A, 100), the activation signal may be delayed two clock cycles.

Accordingly, the selected actuator (FIG. 1A, 102) is activated (block 302) based on the activation signal. For example, in thermal inkjet printing, the heating element in a thermal ejector (FIG. 2B, 216) is heated so as to generate a drive bubble that forces fluid out the nozzle orifice (FIG. 2B, 222). The firing of a particular nozzle (FIG. 2B, 220) generates a first voltage output by the corresponding actuator sensor (FIG. 1A, 104), which output is indicative of an impedance measure at a particular pant in time. That is, each actuator sensor (FIG. 1A, 104) is coupled to, and in some cases uniquely paired with, an actuator (FIG. 1A, 102). Accordingly, the actuator sensor (FIG. 1A, 104) that is uniquely paired with the actuator (FIG. 1A, 102) that has been fired outputs a first voltage.

To generate the first voltage, a current is passed to an electrically conductive plate of the actuator sensor (FIG. 1A, 104), and from the plate to the fluid or fluid vapor. For example, the actuator sensor (FIG. 1A, 104) may include a tantalum plate disposed between the ejector (FIG. 2B, 216) and the ejection chamber (FIG. 2B, 220). As this current is passed through the actuator sensor (FIG. 1A, 104) plate, and to the fluid or fluid vapor, an impedance is measured and a first voltage determined.

In some examples, activating (block 302) the actuator (FIG. 1A, 102) to obtain a first voltage for activator evaluation may be carried out during the course of forming a printed mark. That is, the firing event that triggers an actuator evaluation may be a firing event to deposit fluid on a portion of the media intended to receive fluid. In other words, there is no dedicated operation relied on for performing activator evaluation, and there would be no relics of the activator evaluation process as the ink is deposited on a portion of an image that was intended to receive fluid as part of the printing operation.

In another example, the actuator (FIG. 1A, 102) is activated (block 302) in a dedicated event independent of a formation of a printed mark. That is, the event that triggers an actuator evaluation may be in addition to a firing event to deposit fluid on a portion of the media intended to receive fluid. That is the actuator may fire over negative space on a sheet of media, and not one intended to receive ink to form an image.

In yet another example, a sub-nucleation activation signal may trigger an actuator evaluation. In this context a sub-nucleation activation signal is too narrow to eject fluid, but can be used to sense shorts within an actuator (FIG. 1A, 102).

An evaluation signal is then received (block 303) for evaluating a characteristic of the actuator (FIG. 1A, 102). As described above, the actuator evaluation device (FIG. 1A, 108) operates to evaluate a condition of the actuator (FIG. 1A, 102) by comparing a voltage output by a corresponding actuator sensor (FIG. 1A, 104) against a threshold voltage. However the results are not captured and output until an evaluation signal enables the actuator evaluation device (FIG. 1A, 108) to store the results of the comparison for further operation. The evaluation signal is delayed (block 304) at the primitive (FIG. 1A, 110) by a predetermined period of time following the activation signal. As with the activation signal, the evaluation signal may be a global signal that passes through each primitive. Also as with the activation signal, the evaluation signal may pass through a similar time-shift chain such that it is delayed upon arrival at the primitive (FIG. 1A, 110). That is, an activation signal arrives at a first primitive (FIG. 1A, 110) and is there delayed it is then passed on to a second primitive (FIG. 1A. 110) where it is delayed. Similarly, the evaluation signal arrives at a first primitive (FIG. 1A, 110) and is there delayed, it is then passed on to a second primitive (FIG. 1A, 110) where it is again delayed.

When this delayed evaluation signal is received, an actuator characteristic is then evaluated (block 305) based at least in part on a comparison of the first voltage and the threshold voltage. In this example, the threshold voltage may be selected to dearly indicate a blocked, or otherwise malfunctioning, actuator (FIG. 1A, 102). That is, the threshold voltage may correspond to an impedance measurement expected when a drive bubble is present in the ejection chamber (FIG. 2B, 220). i.e., the medium in the ejection chamber (FIG. 2B, 220) at that particular time is fluid vapor. Accordingly, if the medium in the ejection chamber (FIG. 2B, 220) were fluid vapor, then the received first voltage would be comparable to the threshold voltage. By comparison, if the medium in the ejection chamber (FIG. 2B, 220) is print fluid such as ink, which may be more conductive than fluid vapor, the impedance would be lower and a lower voltage would be output. Accordingly, the pre-charged threshold voltage is configured such that a voltage lower than the threshold indicates the presence of fluid, and a voltage higher than the threshold indicates the presence of fluid vapor. If the first voltage is thereby greater than the pre-charged threshold voltage, it may be determined that a drive bubble Is present and if the first voltage is lower than the pre-charged threshold voltage, it may be determined that a drive bubble is not present when it should be, and a determination made that the nozzle (FIG. 1A, 102) is not performing as expected. While specific reference is made to output a low voltage to indicate low impedance, in another example, a high voltage may be output to indicate low impedance.

In some examples, the threshold voltage against which the first voltage is compared depends on an amount of time passed since the activation of the actuator (FIG. 1A, 102). For example, as the drive bubble collapses, the impedance in the ejection chamber (FIG. 2B, 220) changes over time, slowly returning to a value indicating the presence of fluid. Accordingly, the pre-charged threshold voltage against which the first voltage is compared also changes over time.

Figure 4:
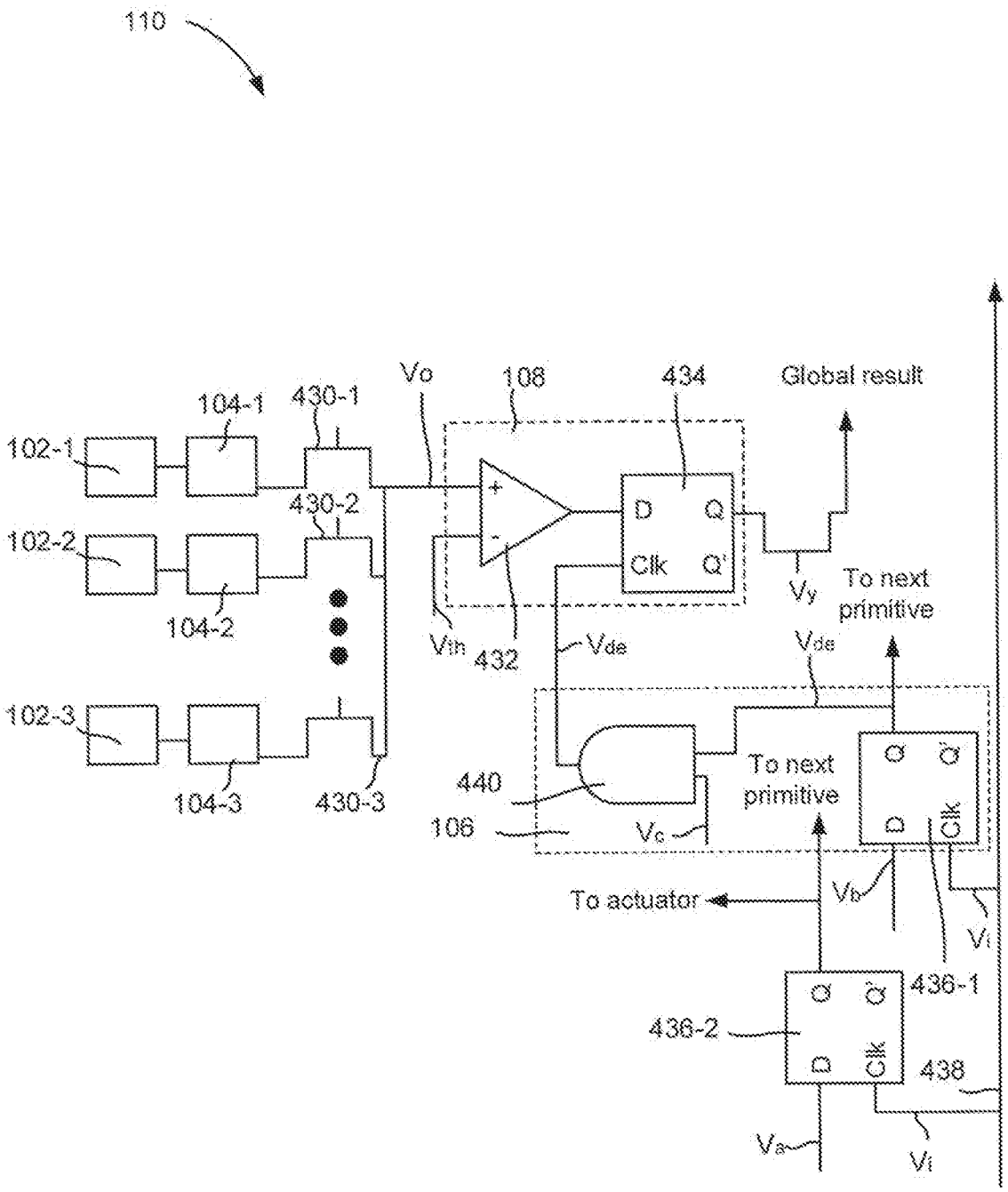
FIG. 4 is a circuit diagram of on-die time-shifted actuator evaluation components, according to another example of the principles described herein.

FIG. 4, is a circuit diagram of on-die time-shifted actuator evaluation components, according to another example of the principles described herein. Specifically. FIG. 4 is a circuit diagram of one primitive (110). As described above, the primitive (110) includes a number of actuators (102) and a number of actuator sensors (104) coupled to respective actuators (102). During operation, a particular actuator (102) is selected for activation. While active, the corresponding actuator sensor (104) is coupled to the actuator evaluation device (108) via a selecting transistor (430-1, 430-2, 430-3). That is, a selecting transistor (430) forms a connection between the actuator evaluation device (108) and the selected actuator sensor (104). The selecting transistor being actuated also allows a current to pass through to the corresponding actuator sensor (104) such that an impedance measure of the ejection chamber (FIG. 2B, 220) within the actuator (102) can be made.

In this example, the actuator evaluation device (108) includes a compare device (432) to compare a voltage output, $V_o$, from one of the number of actuator sensors (104) against the threshold voltage, $V_{th}$, to determine when a corresponding actuator (102) is malfunctioning or otherwise inoperable. That is, the compare device (432) determines whether the output of the actuator sensor (104), $V_o$, is greater than or less than the threshold voltage, $V_{th}$. The compare device (432) then outputs a signal indicative of which is greater.

The output of the compare device (432) may then be passed to an evaluation storage device (434) of the actuator evaluation device (108). In one example, the evaluation storage device (434) may be a flip-flop device that stores the output of the compare device (432) and selectively passes the output on. For example, the actuator sensor (104), the compare device (432), and the evaluation storage device (434) may be operating continuously to evaluate actuator characteristics and store a binary value relating to the state of the actuator (102). Then when an evaluation signal, $V_{de}$, is passed to enable the evaluation storage device (434), the information stored in the evaluation storage device (434) is passed on as an output from which any number of subsequent operations can be performed.

The evaluation signal $V_{de}$, may be a delayed evaluation signal. That is the storing, and selective passing, of the output of the compare device (432) may be delayed with respect to a global evaluation signal. A first time-shift chain component (FIG. 1A, 106) such as a first delay flip-flop (436-1) may facilitate such a delayed evaluation signal In some examples, the activation signal that activates a particular actuator (102) may be a delayed activation signal. For example a global activation signal, $V_a$, may be passed to a second delay flip-flop (436-2) of a time-shift chain of the activation signal. This initial activation signal waits for an enable signal, $V_i$, from a clock transmission line (438). With both an activation signal, $V_a$, on a "D" port of the second delay flip-flop (436-2) and an enable signal, $V_i$, on the "Clk" port an output is generated on the "Q" port which is 1) passed to an actuator (102) for activation, and 2) is passed to another similar flip-flop in a subsequent primitive (110) where it is further delayed. That is the signal passes to a "D" port of a flip-flop in another primitive (110) and waits another enable signal to its respective "Clk" port. In this fashion, the activation signal at the second primitive is delayed relative to the activation signal of the present primitive (110). Going up the primitives (110) in a column in this fashion can result in a delay on the order of microseconds such that there is a gradual activation of all the actuators that are to be fired.

In some examples, the evaluation signal that activates the actuator evaluation device (108) may be a delayed evaluation signal. For example, a global evaluation signal, $V_b$, may be passed to a first delay flip-flop (436-1) of a time-shift chain of the evaluation signal. This initial evaluation signal waits for an enable signal, $V_i$, from a dock transmission line (438). With both an evaluation signal, $V_b$, on a "D" port of the first delay flip-flop (436-1) and an enable signal, $V_i$, on the "Clk" port, an output is generated on the "Q" port which is 1) passed to an actuator evaluation device (108) for activation, and 2) is passed to another similar flip-flop in a subsequent primitive (110) where it is further delayed. That is, the signal passes to a "D" port of a flip-flop in another primitive (110) and waits another enable signal to its respective "Clk" port. In this fashion, the evaluation signal at the second primitive is delayed relative to the evaluation signal of the present primitive (110). Going up the primitives (110) in a column in this fashion can result in a delay on the order of microseconds such that there is a gradual activation of all the actuators that are to be fired.

Figure 5:
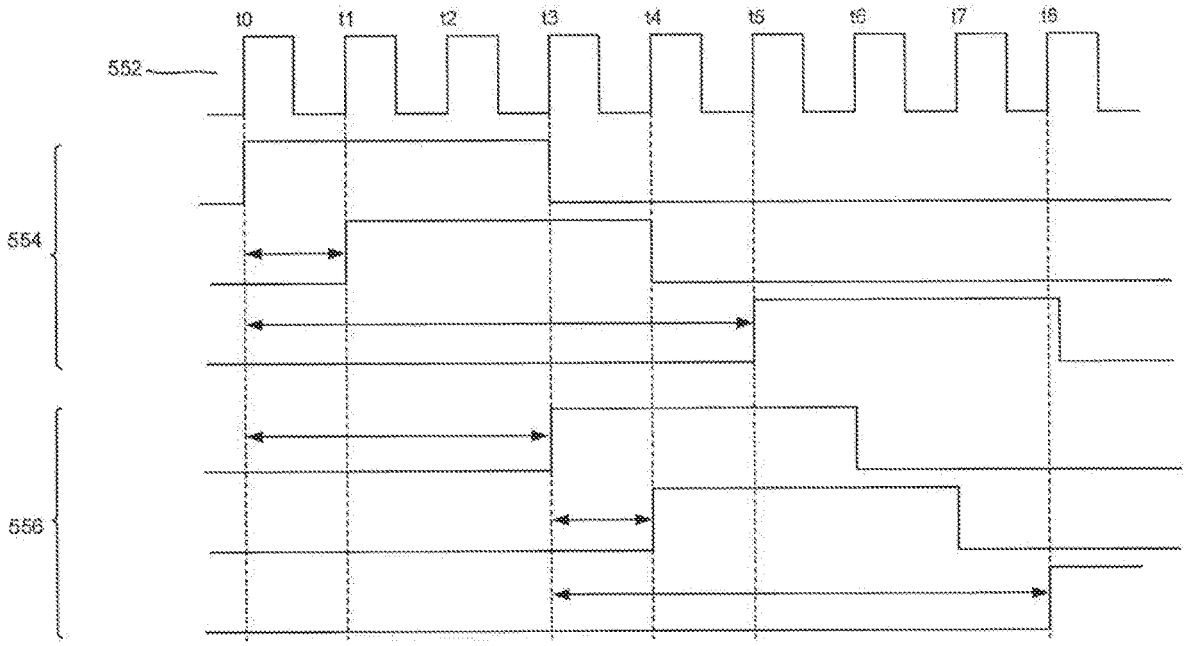
FIG. 5 is a delay sequence, according to an example of the principles described herein.

In some examples, the delay in both of the activation signal and the evaluation signal are provided by the same dock transmission line (438). Doing so ensures that the delays between an activation and evaluation are the same, thus ensuring that the desired gap between activation and evaluation is maintained regardless of any delay imposed on the activation signal. For example, if a desired gap between an activation and an evaluation of an actuator (102) is 3 clock cycles, a delay of one clock cycle via the second delay flip-flop (436-2) could impact this desired gap. However, the presence of the time-shift chain component (FIG. 1A, 106), i.e., the first delay flip-flop (436-1), delays the evaluation signal to the same degree as the activation signal. Accordingly, the desired gap can be maintained at 3 clock cycles. FIG. 5 provides an example of such a scenario.

While FIG. 4 depicts one delay flip-flop (436) per signal per primitive (110), additional flip-flops (436) could be disposed per signal to effectuate greater delays.

The time-shift chain component (FIG. 1A, 106) also includes a gate (440) to allow the delayed evaluation signal, $V_{de}$, to pass to the actuator evaluation device based on a control signal, $V_c$. That is when a control signal, $V_c$, indicates the delayed evaluation signal, $V_{de}$, is passed to enable the actuator evaluation device (108) to carry out the evaluation operation. In some examples, the output of the actuator evaluation device (108) is passed to a global result line when an activation signal, $V_y$, applied at a gate of the transistor couples the actuator evaluation device (108) to the global result line for subsequent operations, such as disabling and fire-forwarding.

In some examples, the actuator evaluation device (108) may process multiple instances of a first voltage against multiple values of a threshold to determine whether an actuator is blocked, or otherwise malfunctioning. For example, over multiple activation events, the first voltage may be sampled at different times relative to the activation event, corresponding to different phases of drive bubble formation and collapse. Each time the first voltage is sampled, it might be compared against a different threshold voltage. In this example, the actuator evaluation device (108) could either have unique latches to store the result of each comparison, or a single latch, and if the sensor voltage is ever outside of the expected range (given the time at which it was sampled), that actuator (102) can be identified as defective. In this case single latch stores a bit which represents "aggregate" actuator status. In the case of multiple storage devices, each may store the evaluation result for a different sample time, and the aggregate collection of those bits can allow for the identification of not only the actuator state, but also the nature of the malfunction. Knowing the nature of the malfunction can inform the system as to the proper response (replace the nozzle, service the nozzle [i.e. multiple spits or pumps], clean the nozzle, etc.).

FIG. 5 is a delay sequence, according to an example of the principles described herein. Specifically, depicted is a clock signal (552), a set of activation signals (554), and a set of evaluation signals (556). In this example, a desired gap between activation of an actuator in a primitive (FIG. 1A, 110) and evaluation of the same actuator (FIG. 1A, 102) is 3 clock cycles. At a time t0, an activation signal is passed along a column and received at a first primitive (FIG. 1A, 110). At the first primitive (FIG. 1A, 110), the signal is delayed until time t1. This delayed signal is then passed to the second primitive (FIG. 1A, 110) where it is again delayed. In this fashion, the activation signal (554) is sequentially delayed such that a fire signal is delayed at a fifth primitive until a time t5. In a similar fashion, the evaluation signal (556) is delayed, the difference being that the initial evaluation signal is not passed until a time t3. That is, at each primitive (FIG. 1A, 110), the evaluation signal is delayed one clock cycle such that at each primitive (FIG. 1A, 110) the delay between the activation signal (554) and the evaluation signal (556) is maintained, i.e., 3 clock cycles.

In summary, using such a fluid ejection die 1) allows for nozzle evaluation circuitry to be disposed on the die itself, as opposed to sending sensed signals to nozzle evaluation circuitry off die; 2) increases the efficiency of bandwidth usage between the device and die; 3) reduces computation overhead for the device in which the fluid ejection die is disposed; 4) provides improved resolution times for malfunctioning nozzles; 5) allows for actuator evaluation in one primitive while allowing continued operation of actuators in another primitive; 6) places management of nozzles on the fluid ejection die as opposed to on the printer in which the fluid ejection die is installed; and 7) improves the accuracy of actuator evaluation by allowing for delayed activation signals to be used, which reduce the effects of noise on any activation of an actuator. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection die comprising:

a number of actuator sensors disposed on the fluid ejection die to sense a characteristic of a corresponding actuator and to output a first voltage corresponding to the sensed characteristic, wherein:

each actuator sensor is coupled to a respective actuator; and multiple coupled actuator sensors and actuators are grouped as primitives on the fluid ejection die;

an actuator evaluation device per primitive to evaluate an actuator characteristic of any actuator within the primitive based on the first voltage and a threshold voltage; and a time-shift chain component per primitive to communicate a delayed evaluation signal, which delayed evaluation signal delays an evaluation of the actuator characteristic a predetermined amount of time following an activation signal.

2. The fluid ejection die of claim 1, wherein the number of actuator sensors comprise impedance sensors that sense an impedance within an ejection chamber of a corresponding actuator.

3. The fluid ejection die of claim 1, wherein:

an activation event is triggered by the activation signal which is a delayed activation signal; and the delayed evaluation signal is delayed a predetermined amount of time following the delayed activation signal.

4. The fluid ejection die of claim 1, wherein the actuator evaluation device comprises:

a compare device to compare the first output against the threshold voltage; and an evaluation storage device to:

store an output of the compare device; and selectively pass an output of the compare device as indicated by the delayed evaluation signal.

5. The fluid ejection die of claim 1, wherein the time-shift chain component comprises:

a number of delay flip-flops electively activated to generate a delayed evaluation signal specific to an actuator based on a global evaluation signal; and a gate to allow the evaluation signal to pass to the actuator evaluation device based on a control signal.

6. The fluid ejection die of claim 1, further comprising a second time-shift chain comprising a number of delay flip-flops electively activated to generate a delayed activation signal specific to an actuator based on a global activation signal.

7. The fluid ejection die of claim 1, wherein the delayed evaluation signal is coupled to a gate of a transistor to allow an output of the actuator evaluation device to pass to a global result line.

8. A fluid ejection system comprising:

multiple fluid ejection dies, wherein a fluid ejection die comprises:

a number of drive bubble detection devices to output a first voltage indicative of a state of a corresponding actuator, wherein:

each drive bubble detection device is coupled to a respective actuator; and multiple coupled drive bubble detection devices and actuators are grouped as primitives on the fluid ejection die;

an actuator evaluation device per primitive to evaluate an actuator characteristic of the actuator based at least in part on a comparison of the first voltage and a threshold voltage; and a time-shift chain component to communicate a delayed evaluation signal, which delayed evaluation signal delays an evaluation of the actuator characteristic a predetermined amount of time following an activation event.

9. The fluid ejection system of claim 8, wherein:

the number of drive bubble detection devices are uniquely paired with the number of actuators;

the actuator evaluation device is uniquely paired with a primitive of actuators; and the time-shift chain component is paired with the primitive of actuators.

10. The fluid ejection system of claim 8, wherein the number of drive bubble detection devices measure an impedance from within an ejection chamber to detect a drive bubble, the presence of a drive bubble indicating an operational actuator.

11. A method comprising:

receiving an activation signal for activating an actuator of a primitive;

activating the actuator based on the activation signal;

receiving an evaluation signal for evaluating a characteristic of the actuator;

delaying the evaluation signal at the primitive by a predetermined amount of time following the activation signal; and evaluating the characteristic of the actuator based on the delayed evaluation signal.

12. The method of claim 11, wherein evaluating the characteristic of the actuator comprises comparing a first voltage corresponding to an impedance measurement from within an ejection chamber of the actuator during firing against a threshold voltage to determine if a nozzle is malfunctioning.

13. The method of claim 11, wherein delaying the evaluation signal comprises:

receiving the delayed evaluation signal at a second input of the gate, which delayed evaluation signal is generated based on a global evaluation signal and a flip-flop activation signal; and allowing the delayed evaluation signal to pass based on the reception of a control signal at a second input of the gate.

14. The method of claim 11, further comprising passing an output of an actuator evaluation device to a global result line.

15. The method of claim 14, wherein passing an output of the actuator evaluation device to a global line comprises activating a transistor of the actuator evaluation device via a control signal.

* * * * *